United States Patent [19]

Russell

[11] 4,335,665

[45] Jun. 22, 1982

[54] TOOL FOR WEAVING

[76] Inventor: John Russell, Martin Rd., LaGrangeville, N.Y. 12540

[21] Appl. No.: 150,244

[22] Filed: May 15, 1980

[51] Int. Cl.[3] ..... D05C 15/06

[52] U.S. Cl. ..... 112/80; 139/1 F; 223/103

[58] Field of Search ..... 139/1 F, 7 D; 112/80; 223/102, 103 X

[56] References Cited

U.S. PATENT DOCUMENTS

| | | | |
|---|---|---|---|
| 695,788 | 3/1902 | Brown et al. | 112/80 X |
| 1,635,670 | 7/1927 | Hathaway | 139/7 D |
| 1,919,813 | 7/1933 | Tibbutt | 112/80 |

FOREIGN PATENT DOCUMENTS

| | | | |
|---|---|---|---|
| 915059 | 1/1963 | United Kingdom | 139/7 D |

*Primary Examiner*—Henry Jaudon

*Attorney, Agent, or Firm*—Kenyon & Kenyon

[57] ABSTRACT

The weaving tool is provided with a pair of pivotally mounted elements and a spring for biasing the elements together. The forward portion of the tool is made with a thin tapered portion and the material engaging portions mate with each other to form a continuation of the forward portion. The forward portion of the tool may pass through a mesh backing without significantly enlarging the holes of the backing. The tool is positioned in the backing so that upon opening, the holes in the backing are not enlarged. Strips of material can be pulled back through the openings when the tool is removed.

10 Claims, 5 Drawing Figures

TOOL FOR WEAVING

This invention relates to a tool for weaving. More particularly, this invention relates to a tool for manual weaving of rugs.

Heretofore, various types of tools have been known for weaving items such as rugs. In many cases, use has been made of latch hooks wherein a pointed end of the hook can be passed through a backing material and thereafter opened to grasp a yarn or the like. Upon closing of the opened end of the latch hook, both the latch hook and yarn can be pulled through the opening in the backing. This operation can be repeated until the yarn has been woven into the backing to form a rug, for example, of the hooked type. It has also been known to use similar techniques for weaving yarns into a backing with the yarns being severed to form a rug with a tufted configuration. In this case, the yarns stand upwardly from the backing with free ends.

The known latch hooks and similar tools, however, upon passing through the backing and upon opening to engage a yarn enlarge the holes in the backing so that the yarns which are pulled through the holes are loosely mounted. As a result, the yarns can work loose over a period of time and the rugs may become unraveled.

Accordingly, it is an object of this invention to provide a tool for weaving rugs which provides for a tight securement of the woven in materials.

It is another object of the invention to provide a tool for weaving rugs from strips of material.

It is another object of the invention to provide a relatively simple tool which can be used to weave individual strips of material into a canvas backing in a secure manner.

Briefly, the invention provides a tool for weaving which is comprised of a pair of elements which are pivotally mounted with respect to each other. One element is elongated and has a handle portion at one end, a tapered portion at an opposite end and a material gripping portion intermediate the two ends. The second element is pivotally mounted on the first element between the material gripping portion and the handle portion and has a shaped portion at one end spaced from the handle portion of the opposite element and a material gripping portion at an opposite end which faces the material gripping portion of the first element.

In addition, the tool has means for biasing the material gripping portions of the two elements into mating engagement. This means is in the form of a spring disposed between the handle portion of one element and the shaped portion of the other element.

In order to provide for the pivot mounting of one element on the other, a pivot means is provided which includes a stem secured to the second element, a bore in the first element which receives the stem in spaced concentric relation and a pin which is secured transversely to the stem and rotatably received in the first element within the bore. The gripping portions of each element may be of any suitable shape and may include a plurality of teeth.

Further, the pivotally mounted element terminates at the end of the material gripping portion so that the tapered portion of the first element defines a forward end of the tool. In this regard, the two material gripping portions define a smooth outer contour and form an extension of the tapered portion of the first element.

The tool may also be provided with a curvilinear element on the handle portion in order to define a finger-grip.

The tool is conveniently sized to be manually operated. When in use, the tool is inserted through a backing material, such as a canvas material which is woven with relatively small mesh openings. Preferably, the tool is inserted through a folded over portion of the backing so that two aligned holes of limited size are formed in the backing. The extent of penetration of the tool is such that the point at which the two elements of the tool are pivoted together is located within the plane of the folded backing layers. Thereafter, the tool is opened to grasp the end of a strip of material, for example, a two inch strip having a width of about one inch. After the strip is inserted, the tool is closed and pulled back through the backing to pull the strip partially through the two backing layers. Next, the tool is opened to release the strip of material. At this time, the strip extends through the two holes in the folded backing. When the backing is flattened, the two ends of the strip are turned upwardly in perpendicular relation to the backing to give a tufted appearance. Other strips of material can be similarly inserted into the backing to form a rug.

The backing can be folded in such a fashion that the two openings which are formed by the tool are relatively close together so that the upstanding ends of the inserted pieces of material can be close together.

Since the material gripping portions of the tool are not located within the plane of the canvas backing layers, the holes which are made in the backing during the initial insertion of the tool do not become enlarged when the tool is opened to grasp a strip of material. Consequently, the material which is drawn through the holes can be firmly held within the backing.

In order to enhance securement of the material strips, an additional backing can be glued or bonded to the underside of the original backing to fix the loops of the material strips on the backside of the backing in a positive manner.

These and other objects and advantages of the invention will become more apparent when taken in conjunction with the following description and appended drawings in which.

Figures 1, 2, 3, 4, 5:
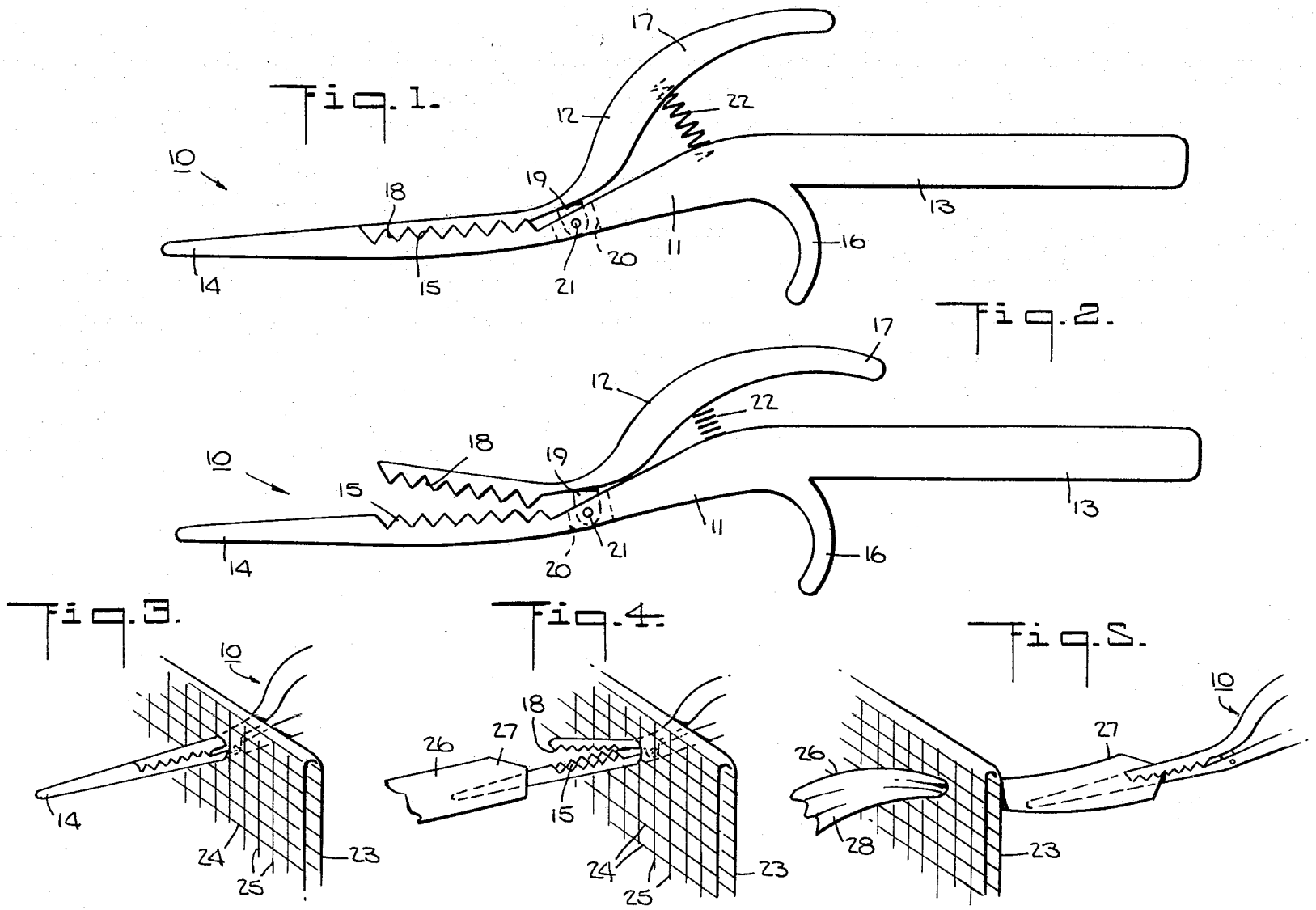
FIG. 1 illustrates a side view of a weaving tool in accordance with the invention.
FIG. 2 illustrates a side view of the tool of FIG. 1 in an opened condition.
FIG. 3 illustrates a perspective view of the weaving tool of FIG. 1 passing through a folded over backing.
FIG. 4 illustrates a view similar to FIG. 3 with the tool in an opened condition to receive a strip of material.
FIG. 5 illustrates a view of a strip of material pulled through a backing by the tool of FIG. 1.

Referring to FIG. 1, the weaving tool is comprised of a pair of elements 11, 13. One element 11 is elongated and has a handle portion 13 at one end, a tapered portion 14 at the opposite end and a material gripping portion 15 intermediate the ends. The material gripping portion 15 is formed of a plurality of teeth. The other element 12 is of shorter length and is pivotally mounted on the elongated element 11 at a pivot point between the material gripping portion 15 and the handle portion 13. This other element 12 has a shaped portion 17 at one end spaced from the handle portion 13 and a material gripping portion 18 in the form of a plurality of teeth at an opposite end facing the material gripping portion 15.

As shown in FIG. 1, the shorter element 12 terminates with the material gripping portion 18 so that the tapered portion 14 of the elongated element 11 defines a forward end of the tool 10. Further, the gripping portions 15, 18 mate with each other so as to define a smooth outer contour which acts as an extension of the tapered portion 14.

The two elements 11, 12 are made of metal or of any other suitable material.

The tool 10 also has a curvilinear element 16 secured integrally with the handle portion 13 so as to define a finger grip.

A pivot means is also provided for pivotally mounting the shorter element 12 on the elongated element 11. This pivot means includes a stem 19 secured to the shorter element 12 between the shaped portion 17 and material gripping portion 18, a bore 20 in the elongated element 11 within a tapered forward section of the handle portion 13 and a pin 21 which is secured transversely to the stem 19 and which is rotatably received in the handle portion 13 within the bore 20.

As shown, the handle portion 13 and tapered portion 14 of the elongated element 11 are disposed on longitudinal axes which are somewhat offset from each other. In addition, the forward end of the handle portion 13 tapers from the remainder of the handle portion 13 towards the tapered portion 14. The shaped portion 17 of the shorter element 12 is curved in relation to the offset portions 13, 14 of the element 11.

The handle portion 13 may be of circular cross-section or of rectangular cross-section. The tapered portion 14 is of generally circular cross-section which extends from a slightly rounded tip at the forward end into and through the material gripping portions 14, 18.

Referring to FIG. 1 the tool also has a means such as a coil spring 22 disposed between the handle portion 13 and the shaped portion 17 in order to bias the material gripping portions 15, 18 of the elements 11, 12 into mating engagement with each other. As indicated in FIG. 2, the spring 22 is sized so as to permit the shaped element 12 to be pivoted on the elongated element 11 to move the material gripping portions 15, 18 away from each other.

In use, a backing such as a canvas backing woven of various warp and weft yarns 24, 25 is folded over on itself. Thereafter, the tool 10 is passed through the two layers of the backing 23 so that the forward end of the tool pierces through the two layers. At this time, the tapered portion 14 of the tool passes through the relatively small mesh openings of the backing and slightly enlarges two aligned mesh openings. The amount of penetration is sufficient to place the pivot means of the tool 10 within the plane of the two backing layers. Thereafter, as shown in FIG. 4, the tool is opened so that a strip of material 26 can be inserted between the two material gripping portions 15, 18. At this time, since the two material gripping portions 15, 18 are outside the plane of the backing layers, the openings which have been made in the backing during passage of the tool 10 therethrough are not enlarged.

After the tool 10 has been closed so as to grip the strip of material 26, the tool is withdrawn from the backing 23 to pull the strip 26 through the two layers. As shown in FIG. 5, the strip 26 is pulled approximately half way through the backing 23 to leave two ends 27, 28 projecting from the backing 23.

Referring to FIG. 4, the strip of material 26 is of a larger width than the openings in the backing 23. For example, the strip 36 may be of a two inch length with a half inch width, whereas the holes in the backing 23 made by the tool 10 are of smaller width. Thus, the leading end 27 of the strip 26 is made pointed to permit the strip to be bunched up during passage through the openings.

After each strip 26 has been pulled into the backing 23, the tool 10 can be released from the strip 23. The backing 23 may then be folded out flat and the two ends 27, 28 of the material strip 26 turned substantially perpendicularly to the backing 23 to give a tufted appearance. By weaving a multiplicity of material strips 26 into the backing 23, a throw rug or a like article can be made.

It is to be noted that the canvas backing may be doubled over more than once prior to insertion of the tool 10. In this case, the tool 10 may pass through four or six layers of backing (not shown). After pulling a strip of material through the various layers and unfolding the backing, the material strip can be cut to provide two ends for each resulting piece which is anchored in two adjacent holes of the backing. Alternatively, the strip of material which has been woven into the backing in this manner may be cut at selective places so that a woven appearance is given to, at least, part of the resulting rug.

It is to be noted that the tool is suitably shaped in the area of the pivot between the two elements 11, 12 so as to have a substantially uniform thickness whereby upon pivoting of the shorter element 12 about the pin 21, an insignificant enlargement of a hole in a backing is made.

The invention thus provides a tool for weaving rugs which is of relatively simple construction and which can weave strips of material into a rug in a firmly anchored manner.

Further, the weaving tool can be used with any suitable size of material strips. The strips may be made, for example, from discarded materials such as shirts, pants, dresses and the like.

The invention further provides a weaving tool which permits the circumference of the openings in the backing through which the material is pulled to be as tight (i.e. small) as possible. Because of the construction of the elongated barlike element 11, the yarns of the backing are little disturbed. Further, the pencil thin smooth tapered portion 14 of the tool may easily penetrate a canvas backing while separating the yarns of the backing no more than the thickness of the tapered portion itself.

What is claimed is:

1. A tool for weaving comprising a first elongated element having, a smooth tapered portion at one end, a handle portion at an opposite end offset from said tapered portion, a curvilinear element secured to said handle portion to define a finger-grip and a material gripping portion intermediate said ends;

a second element pivotally mounted on said first element at a pivot point between said material gripping portion and said handle portion, said second element having a shaped portion at one end spaced from said handle portion and a material gripping portion at an opposite end facing and mating with said material gripping portion of said first element to define a smooth outer contour for passage through a mesh opening of a backing; and means biasing said material gripping portions of said elements into mating engagement with each other.

2. A tool as set forth in claim 1 wherein said means is a spring disposed between said handle portion and said shaped portion.

3. A tool as set forth in claim 1 wherein each gripping portion includes a plurality of teeth.

4. A tool as set forth in claim 1 which further includes a pivot means at said pivot point pivotally mounting said second element on said first element, said pivot means including a stem secured to said second element, a bore in said first element receiving said stem in spaced concentric relation and a pin secured transversely to said stem and rotatably received in said first element within said bore.

5. A tool as set forth in claim 4 which further includes a curvilinear element secured to said handle portion to define a finger-grip.

6. A tool as set forth in claim 5 wherein each said element is made of metal.

7. A tool as set forth in claim 1 wherein said material gripping portions of said elements define a smooth outer contour as an extension of said tapered portion of said first element.

8. A tool as set forth in claim 1 wherein said handle portion and said tapered portion are disposed on longitudinal axes offset from each other.

9. A tool as set forth in claim 1 being of substantially uniform thickness in an area of said pivot point between said elements.

10. A tool for weaving comprising a first elongated element having a handle portion at one end, a smooth tapered portion at an opposite end, a material gripping portion intermediate said ends and a curvilinear element secured to said handle portion to define a finger-grip;

a second element pivotally mounted on said first element at a pivot point between said material gripping portion and said handle portion, said second element having a shaped portion at one end spaced from said handle portion and a material gripping portion at an opposite end facing and mating with said material gripping portion of said first element to define a smooth outer contour for passage through a mesh opening of a backing, a pivot means at said pivot point pivotally mounting said second element on said first element, said pivot means including a stem secured to said second element, a bore in said first element receiving said stem in spaced concentric relation and a pin secured transversely to said stem and rotatably received in said first element within said bore; and means biasing said material gripping portions of said elements into mating engagement with each other.

* * * * *